US007121064B2

(12) United States Patent
Ausnit

(10) Patent No.: US 7,121,064 B2
(45) Date of Patent: Oct. 17, 2006

(54) METHOD FOR DUAL MANUFACTURE OF RECLOSABLE BAGS OF HFVF MACHINE

(75) Inventor: Steven Ausnit, New York, NY (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 11/056,556

(22) Filed: Feb. 11, 2005

(65) Prior Publication Data

US 2005/0132668 A1 Jun. 23, 2005

Related U.S. Application Data

(62) Division of application No. 10/340,422, filed on Jan. 10, 2003, now abandoned.

(51) Int. Cl.
*B65B 61/18* (2006.01)

(52) U.S. Cl. ..... 53/412; 53/133.4; 53/139.2; 53/450; 53/452; 493/927

(58) Field of Classification Search ..... 53/133.4, 53/139.2, 399, 412, 450, 452, 562; 493/212–214, 493/927; 428/34.1, 35.2, 35.7, 99
See application file for complete search history.

(56) References Cited

U.S. PATENT DOCUMENTS

| | | | | |
|---|---|---|---|---|
| 4,031,723 | A * | 6/1977 | Samhammer et al. | 70/68 |
| 4,635,294 | A * | 1/1987 | Bentsen | 383/37 |
| 4,756,628 | A * | 7/1988 | Branson | 383/63 |
| 4,923,309 | A * | 5/1990 | VanErden | 383/5 |
| 4,993,844 | A * | 2/1991 | Robinson et al. | 383/38 |
| 5,023,122 | A * | 6/1991 | Boeckmann et al. | 428/43 |
| 5,100,000 | A * | 3/1992 | Huseman | 206/554 |
| 5,116,301 | A * | 5/1992 | Robinson et al. | 493/215 |
| 5,503,856 | A * | 4/1996 | Hustad et al. | 426/108 |
| 6,040,033 | A * | 3/2000 | Johnson | 428/99 |
| 6,579,008 | B1 * | 6/2003 | Price et al. | 383/38 |
| 2003/0089084 | A1 | 5/2003 | Ausnit | 53/412 |
| 2004/0134166 | A1 * | 7/2004 | Ausnit | 53/412 |
| 2005/0120678 | A1 * | 6/2005 | Ausnit | 53/412 |

* cited by examiner

*Primary Examiner*—Louis K. Huynh
*Assistant Examiner*—Thanh Truong
(74) *Attorney, Agent, or Firm*—Ostrager Chong Flaherty & Broitman P.C.

(57) ABSTRACT

A method for dual manufacture of reclosable packages on a horizontal-form, vertical fill machine. The method comprising the following steps: extending a web of bag making film under tension in a machine direction; joining one zipper tape to the web along a first zone of joinder generally aligned with the machine direction; joining another zipper tape to the web along a second zone of joinder generally parallel to the first zone of joinder and spaced apart therefrom; and folding the web in first, second and third mutually parallel zones extending in the machine direction. The first zone of folding is disposed between a first edge of the web and the one zipper tape, the second zone of folding is disposed between the two zipper tapes, and the third zone of folding is disposed between the other zipper tape and a second edge of the web. The resulting folded web with attached zippers has a generally W-shaped profile. The two halves of the W-shaped web are cross-sealed, filled, and then top-sealed to form respective chains of filled receptacles. The completed packages are then severed from the respective chains of receptacles.

8 Claims, 11 Drawing Sheets

METHOD FOR DUAL MANUFACTURE OF RECLOSABLE BAGS OF HFVF MACHINE

RELATED PATENT APPLICATION

This application is a divisional of and claims priority from U.S. patent application Ser. No. 10/340,422 filed on Jan. 10, 2003 now abandoned.

BACKGROUND OF THE INVENTION

This invention generally relates to reclosable packaging and methods for manufacturing reclosable packaging. In particular, the invention relates to the manufacture of reclosable packages on a horizontal-form, vertical fill (HFVF) machine.

Reclosable bags are finding ever-growing acceptance as primary packaging, particularly as packaging for foodstuffs such as cereal, fresh vegetables, snacks and the like. Such bags provide the consumer with the ability to readily store, in a closed, if not sealed, package any unused portion of the packaged product even after the package is initially opened. To gain acceptance as a primary package for foodstuffs, it is virtually mandatory that the package exhibit some form of tamper evidence to protect the consumer and maintain the wholesomeness of the contained product. In addition, in many cases it is necessary that food product be hermetically packaged.

Reclosable fastener assemblies are useful for sealing thermoplastic pouches or bags. Such fastener assemblies typically include a plastic zipper and a plastic slider. Typically, the plastic zippers include a pair of interlockable profiled members that fasten together to form a closure. As the slider moves across the profiles, the profiles are opened or closed. The profiles in plastic zippers can take on various configurations, e.g. interlocking rib and groove elements having so-called male and female profiles, interlocking alternating hook-shaped closure members, etc. Reclosable bags having slider-operated zippers are generally more desirable to consumers than bags having zippers without sliders because the slider eliminates the need for the consumer to align the interlockable zipper profiles before causing those profiles to engage.

Methods and apparatus for manufacturing reclosable plastic bags on form-fill-seal (FFS) machines are well known in the art. The use of high-speed automated equipment to form, fill and seal a reclosable package is quite common in the industry.

One known type of FFS machine is a horizontal-form, vertical fill (HFVF) machine that places slider-zipper tape proximal to a fold in a web of bag making film, forms receptacles, and then fills the receptacles through an open package bottom at the top of folded web. This machine typically operates as follows. A pull roller of the HFVF machine draws a continuous length of bag making film dispensed from a supply roll in a machine direction. As the bag making film is dispensed in the machine direction, a flattening roller positions the film on a horizontal plane. At the same time, a continuous length of interlocked zipper tape assembly (without sliders) is unwound from a coil and passed through a slider insertion device. Also a chain or series of sliders is unwound from a coil or supplied by a vibratory hopper and fed to the slider insertion device. The slider insertion device inserts sliders onto the zipper tape at regular spaced intervals corresponding to the length of a zipper in each package. The resulting slider-zipper assembly is placed on the bag making film in alignment with the machine direction. The continuous length of zipper tape assembly with sliders inserted thereon is longitudinally positioned on the bag making film in parallel with and offset from a line where the film will be folded. At a first sealing station, one zipper half is permanently sealed to the film by conduction heat sealing. These permanent seals and the mutual engagement of the zipper profiles maintain the alignment of the slider-zipper assembly with the fold line as the film with attached slider-tape assembly is drawn around a folder plow or board. The folder plow folds the film lengthwise along the fold line. Optionally, as the bag making film is fed over the folder plow, a perforator perforates the film below the interlocking zipper profiles to form respective parallel lines of preferential tearing, where a bag header can be torn off of the package. At a second sealing station, the other zipper half is permanently sealed to the bag making film. At the next station, the opposing walls of the bag making film are cross sealed along a zone transverse to the direction of film movement, the seal zone having sufficient width to form respective side seals on successive packages when the seal zone is cut down the middle by a cutter. The cross seals form discrete receptacles that can be filled before or after the cutting station. After filling, the opposing top edges of the folded web (representing the bottom of the packages) are sealed together at another sealing station, forming a bottom seal. If the bags have been filled before the cutting station, the bag making film is then cut along a side seal to separate the filled package from the web of bag making film.

In accordance with variations of the foregoing machine, the slider-zipper tape assembly can be attached proximal to the top edge of the folded web, i.e., opposite the fold, and the package can be filled either by moving the slider to open the zipper (when both zipper halves are sealed to the film) or by separating the slider-zipper tape assembly from an adjacent unsealed wall of the bag making film, filling the receptacle through the resulting gap, and then sealing the unsealed film wall to the slider-zipper tape assembly. Similar methods of manufacture can be used to make zippered bags that do not have sliders for operating the zipper.

There is a need for a method of manufacture and an apparatus for increasing the production capacity of such HFVF machines.

BRIEF DESCRIPTION OF THE INVENTION

The invention is directed to dual manufacture of reclosable packaging on a horizontal form, vertical fill (HFVF) machine. The aspects of the invention, some of which are set forth in greater detail immediately hereinafter, include both methods and apparatus for dual manufacture of reclosable packages, as well as the transitory article of manufacture that is a precursor to the final reclosable packages. The basic concept has application in the manufacture of zippered bags with or without sliders.

One aspect of the invention is an article of manufacture comprising: a web of bag making film folded under tension along first, second and third folds, the folded web reversing its direction along the folds to form a serpentine cross-sectional profile with first through fourth walls, the second wall being disposed between the first and third walls, the third wall being disposed between the second and fourth walls, a bottom of the first wall being connected to a bottom of the second wall along the first fold, a top of the second wall being connected to a top of the third wall along the second fold, and a bottom of the third wall being connected to a bottom of the fourth wall along the third fold, a first zipper tape having a portion disposed between the first and second walls of the web, and joined to at least one of the first and second walls; and a second zipper tape having a portion disposed between the third and fourth walls of the web, and joined to at least one of the third and fourth walls. Each of the first and second zipper tapes comprises first and second mutually interlockable portions in an interlocked state. These zippers may be opened and closed by sliders preloaded on the zippers.

Another aspect of the invention is a method of manufacturing an article, comprising the following steps: extending a web of bag making film under tension in a machine direction; joining a first zipper tape to the web along a first zone of joinder generally aligned with the machine direction; joining a second zipper tape to the web along a second zone of joinder generally parallel to the first zone of joinder of the first zipper tape and spaced apart therefrom; and folding the web in first, second and third mutually parallel zones extending in the machine direction, the first zone of folding being disposed between a first edge of the web and the first zipper tape, the second zone of folding being disposed between the first and second zipper tapes, and the third zone of folding being disposed between the second zipper tape and a second edge of the web. As used herein and in the claims, the term "zone of folding" encompasses both a line of folding and a gradual fold that spans a band-shaped zone. These zippers may be opened and closed by sliders preloaded on the zippers.

A further aspect of the invention is an article of manufacture comprising: a web of bag making film folded under tension along first, second and third folds, the folded web reversing its direction along the folds to form a serpentine cross-sectional profile with first through fourth walls, the second wall being disposed between the first and third walls, the third wall being disposed between the second and fourth walls, a bottom of the first wall being connected to a bottom of the second wall along the first fold, a top of the second wall being connected to a top of the third wall along the second fold, and a bottom of the third wall being connected to a bottom of the fourth wall along the third fold, and a zipper strip comprising a base having a first portion joined to the second wall and a second portion joined to the third wall, wherein the base is folded and wrapped around the second fold of the web. The zipper strip further comprises first and second profiled closure members supported by the base and generally parallel to each other, the first profiled closure member being disposed between the first and second walls of the web, and the second profiled closure member being disposed between the third and fourth walls of the web.

Yet another aspect of the invention is a method of manufacturing an article, comprising the following steps: extending a web of bag making film under tension in a machine direction; joining a zipper strip to the web along a zone of joinder generally aligned with the machine direction, the zipper strip comprising a base joined to the web, and first and second profiled closure members supported by the base and generally parallel to each other; and folding the web and the base of the zipper strip along a zone of folding that overlaps a central portion the zone of joinder, the first and second profiled closure members being disposed on opposite sides of the zone of folding.

A further aspect of the invention is an integrally formed hinged zippered structure comprising first and second profiled closure members, first and second hinge lines, a first web having one end connected to the first closure member and another end connected to the first hinge line, a second web having one end connected to the second closure member and another end connected to the second hinge line, and a third web having one end connected to the first hinge line and the other end connected to the second hinge line. These zippers may be opened and closed by sliders preloaded on the zippers.

Another aspect of the invention is an integrally formed zippered structure comprising a web and first through fourth profiled closure members connected to the web, the first through fourth closure members being disposed generally in parallel with each other, the first closure member being interlocked with the second closure member, and the third closure member being interlocked with the fourth closure member. The web comprises first and second web portions connected by a third web portion. The first web portion comprises a first zone connected to the first closure member and a second zone connected to the second closure member, while the second web portion comprises a third zone connected to the third closure member and a fourth zone connected to the fourth closure member.

Yet another aspect of the invention is a method of manufacturing an article, comprising the following steps: extending a web of bag making film under tension in a machine direction; folding the web in first, second and third mutually parallel zones extending in the machine direction, the folded web reversing its direction along the zones of folding to form a serpentine cross-sectional profile with first through fourth walls, the second wall being disposed between the first and third walls, the third wall being disposed between the second and fourth walls, a bottom of the first wall being connected to a bottom of the second wall along the first fold, a top of the second wall being connected to a top of the third wall along the second fold, and a bottom of the third wall being connected to a bottom of the fourth wall along the third fold; inserting at least a portion of a first zipper tape between the first and second walls of the folded web; inserting at least a portion of a second zipper tape between the third and fourth walls of the folded web; joining the first zipper tape to at least one of the first and second walls; and joining the second zipper tape to at least one of the third and fourth walls. These zippers may be opened and closed by sliders preloaded on the zippers.

A further aspect of the invention is a machine for forming, filling and sealing a folded web of bag making film, the folded web having a serpentine cross-sectional profile comprising first and second folded portions in respective upright positions and open at the tops, and a central inverted folded portion extending in a machine direction, the central inverted folded portion connecting the first folded portion to the second folded portion. The machine comprises: an upright saddle having a generally constant profile in the machine direction, wherein the central inverted folded portion of the web is supported by the saddle and slides along the saddle as the web advances in the machine direction means for cross sealing the first and second folded portions of the web at regular spaced intervals to form respective first and second series of open receptacles; means for filling successive receptacles of the first and second series concurrently; and means for sealing successive filled receptacles of the first and second series closed.

Other aspects of the invention are disclosed and claimed below.

BRIEF DESCRIPTION OF THE DRAWINGS

Reference will now be made to the drawings in which similar elements in different drawings bear the same reference numerals.

DETAILED DESCRIPTION OF THE INVENTION

In accordance with the embodiments of the invention disclosed herein, successive pairs of reclosable packages are manufactured using only one web of bag making film, the bags of each pair being manufactured side-by-side and concurrently. The process starts with unwinding a web of bag making film from a roll and threading it through a form-fill-seal machine. Coming off of the roll, the web is pulled under tension in a generally horizontal plane. The tensioned film is folded along three mutually parallel lines or zones to form a generally W-shaped profile, as will be described in more detail below. Zippers for two lines of bags are attached to the bag making film before or after folding or in between separate folding operations. The two halves of the triply folded web of bag making film are then cross-sealed at regular intervals to form a chain or series of receptacles. Successive pairs of receptacles—one receptacle from each chain—are filled with product. Then the open ends of the filled bags are closed. The dual manufacture of reclosable packages doubles the capacity of a form-fill-seal machine.

The bag making film may be made of a suitable plastic film material for the product to be contained within the package. For example, the film may be a laminate or coextrusion comprising a gas barrier layer and/or a low-melting-point sealant layer. The zipper strips are sealed to the bag making film by permanent seals. It should be appreciated that each permanent seal is a band of joined, e.g., fused, material that extends from one side seal of the bag to the other side seal, thereby securing the zipper to the bag along the width of the bag. The permanent seals are generally parallel to each other and may be formed by any conventional method, such as conduction heat sealing. The invention has application with both slider-operated and sliderless zippered bags. In the former case, the slider is mounted to the profiled closure members of the zipper to facilitate zipper opening and closing in a well-known manner. For proper functioning, the interlockable closure members may have spot seals or ultrasonic stomps at the ends of the zipper halves. These seals ensure the zipper strips will not come apart during use and provide end stops for stopping the slider. The slider 8 is preferably made of a resilient plastic material, such as delrin, polypropylene, PBT, etc. Prior to opening of the package by the consumer, the slider-zipper assembly is frequently covered on the consumer side by an enclosed header that is hermetically sealed. The sealed header provides a tamper-evident feature. Peel seals below or above the zippers may also be provided.

Figure 1:
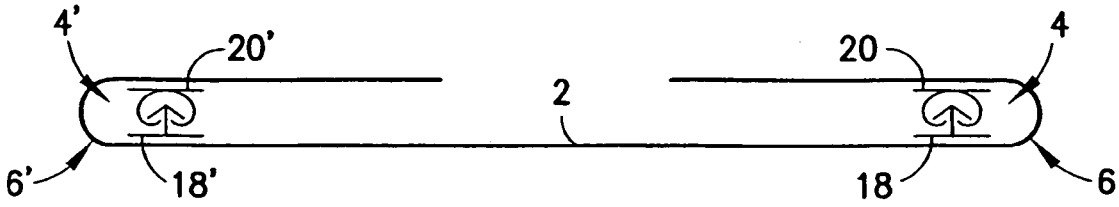
FIG. 1 is a drawing showing a sectional view of a precursor article in accordance with one embodiment of the invention. This view (as well as the views of FIGS. 2–9, 13–15, and 17) is taken at an intermediate stage in the dual manufacture of reclosable packages on a HFVF machine.
Figure 2:
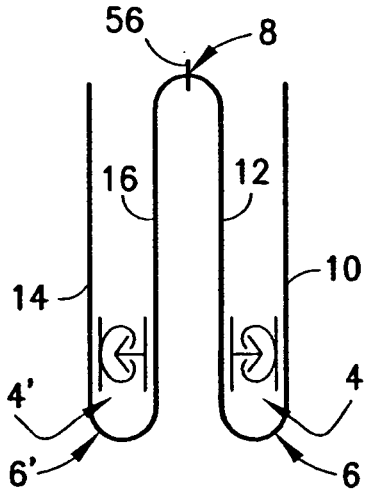
FIG. 2 is a drawing showing a sectional view of the precursor article of FIG. 1 after a further folding step.

FIGS. 1 and 2 show one embodiment of the invention at two stages in the manufacturing process. Two zipper tapes are installed in respective folds of a folded web of bag making film. The zippers are of the webless or so-called "string" variety, meaning that they do not have webs or flanges extending to one side of the profiled closure members. However, sliderless webbed zippers may also be used. A webless or string zipper is attached to bag making film in the base areas of the interlocking closure elements. FIG. 1 shows the intermediate stage after the following steps have been performed: (1) a pair of zipper tapes 4 and 4' are placed atop a flat tensioned web 2 of bag making film aligned with the machine direction (out of the page); (2) the bases of the zipper strips 18 and 18' are sealed or otherwise joined to the web 2 along parallel bands or zones; (3) the web 2 is folded along lines or zones parallel to the foregoing zones of zipper strip joinder to form folds 6 and 6', with the folded portions of the web respectively overlying the zipper tapes 4 and 4'; and (4) the folded portions of web 2 are sealed or otherwise joined to the bases of the zipper strips 20 and 20' of the respective zipper tapes. Although FIG. 1 depicts a gap separating the edges of the folded portions of the web of bag making film, the edges may meet or overlap each other. In FIG. 1, the profiled closure members of the zipper tapes are depicted as having male and female profiles. However, the profiles of the interlocking closure elements need not be of the male/female variety. Any type of interlocking elements, e.g., interlocking hooks, may be utilized.

The precursor structure shown in FIG. 1 is folded along a central zone 8 to form the triply folded structure depicted in FIG. 2. It should be noted that the central fold 8 is formed by folding the bag making film in a direction opposite to that by which folds 6 and 6' were formed. As seen in FIG. 2, the folded web 2 reverses its direction along the folds 6', 8 and 6 to form a serpentine cross-sectional profile with first and second walls 10 and 12 on one side of central fold 8, and third and fourth walls 14 and 16 on the other side of the central fold 8. The bottoms of walls 10 and 12 are connected along fold 6; the tops of wall 12 and 16 are connected along central fold 8; and the bottoms of walls 14 and 16 are connected along fold 6'. The zipper tape 4 is disposed between walls 10 and 12 near fold 6, while the zipper tape 4' is disposed between walls 14 and 16 near fold 6'. In the configuration shown in FIG. 2, both sides of the W-shaped structure can be cross-sealed (not shown) and then filled through the open bottoms of the receptacles formed by cross sealing, i.e., the interior volumes of the receptacles are filled behind the zippers. Then the bottoms of the packages are sealed and a cut 56 is made in fold 8 to sever each pair of filled packages from each other. The respective filled packages at the termini of the respective chains of packages are then severed from the respective chains to form a pair of severed completed packages (not shown).

In the embodiment depicted in FIGS. 1 and 2, the zipper tapes were placed on the flat web of bag making film at locations proximal to the outer zones of folding, giving rise to the precursor structure of FIG. 2 in which the zipper tapes are situated near the bottoms of the U-shaped web troughs. The folded portions 6 and 6' of bag making film serve as headers that provide evidence of tampering with the package. Although not shown in FIG. 2, lines of weakness (such as perforation or laser score lines) can be provided in conventional fashion to aid the tearing away of the header, thereby allowing access to the zipper inside.

Alternatively, the zipper strips can be placed proximal to and on opposite sides of the central folding zone, so that the zipper tapes will be situated near the tops of the troughs and adjacent to the central fold 8. In accordance with another method of manufacture, the folded portions of central fold 8 and the outer edges or adjacent area of the web are sealed to the adjoining zipper strips, in which case the zippers must later be opened in order to fill the receptacles formed by cross sealing. This can be accomplished by separating the zipper strips and adjoining web portions, e.g., by means of a separating finger or plow positioned between the zipper strips. In accordance with another method of manufacture, the outer edges of the web are not sealed to the adjoining zipper strips, in which case the receptacle formed later by cross sealing can be filled by pulling the opposing edges of the folded-over web portions away from the zipper tapes and filling the receptacle through the gaps between the web portions and the zipper tapes. Alternatively, if the zippers are slider operated, then the sliders may be used to open the zipper for filling the receptacle and closing it thereafter.

In accordance with yet another variation, the zipper strips of the respective zipper tapes can be separately joined to the web of bag making film. One pair of zipper strips are sealed in parallel to the machine direction at respective locations proximal to and on opposite sides of the central folding zone, while another pair of zipper strips are sealed in parallel to the first pair of zipper strips at locations proximal to the edges of the web of bag making film. On each half of the web, the inner and outer zipper strips are equidistant from the location where that half of the web will be folded over. In this case the web is folded on both sides and then the zipper strips at the web edges are interlocked with the more centrally located zipper strips. In accordance with a further variation, instead of joining four separate zipper strips to the web of bag making film, the profiled closure members can be integrally formed with the bag making film, e.g., by extrusion. In yet another variation, the zipper strips are sealed to the folded web inside the web folds at the same time. In such an instance, separating plates may be inserted between the zipper strip flanges to prevent seal-through.

Figure 3:
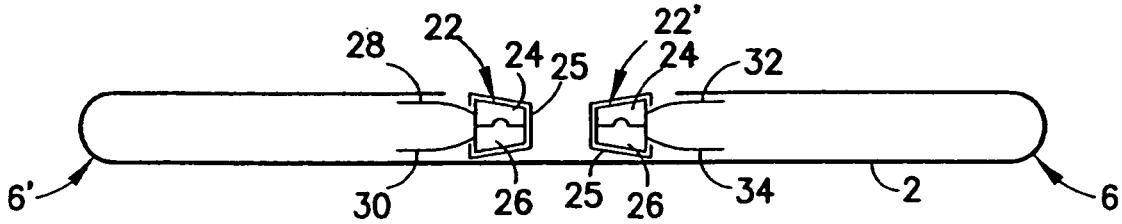
FIG. 3 is a drawing showing a sectional view of a precursor article in accordance with another embodiment of the invention.
Figure 4:
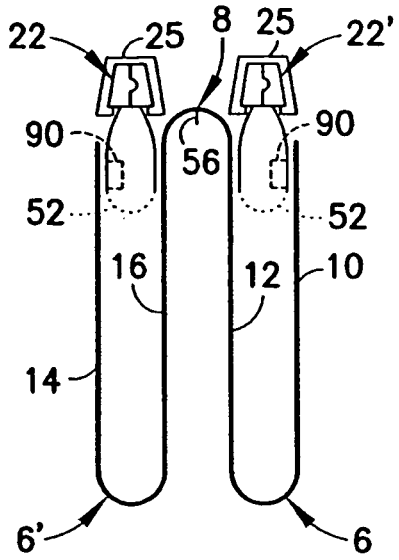
FIG. 4 is a drawing showing a sectional view of the precursor article of FIG. 3 after a further folding step. Structural variations are depicted in dashed or dotted lines.

FIGS. 3 and 4 depict precursor structures for reclosable packaging comprising slider-operated zippers installed at the open tops of the U-shaped folded portions of the web 4. The sliders 25 can be inserted before the zipper tapes 22 and 22' are attached to the web 4 of bag making film or after zipper attachment and folding of the web. Each zipper tape comprising a pair of interlocked zipper strips. For zipper tape 22, one zipper strip comprises a profiled closure member 24 and a flange 28 having one end connected thereto, and the other zipper strip comprises a profiled closure member 26 and a flange 30 having one end connected thereto. For zipper tape 22', one zipper strip comprises a profiled closure member 25 and a flange 32 having one end connected thereto, and the other zipper strip comprises a profiled closure member 27 and a flange 34 having one end connected thereto. The profiles of the closure members may have any known configuration, e.g., male/female, interlocking hooks, etc.

FIG. 3 shows the intermediate stage after the following steps have been performed: (1) a pair of zipper tapes 22 and 22' are placed atop a flat tensioned web 2 of bag making film aligned with the machine direction; (2) the flange 30 of one zipper strip and the flange 34 of the other zipper strip are sealed or otherwise joined to the web 2 along parallel bands or zones; (3) the web 2 is folded along lines or zones parallel to the foregoing zones of flange joinder to form folds 6 and 6', with the folded portions of the web respectively overlying the zipper flanges 28 and 32; and (4) the folded portions of web 2 are sealed or otherwise joined to the zipper flanges 28 and 32. Although FIG. 3 depicts the edges of the folded portions of the web of bag making film as not extending beyond the zipper flanges to which they are attached, the folded portions of the web may extend beyond the zipper tapes for later use in the formation of tamper-evident headers for the packages (as will be described later with reference to FIG. 20). Alternatively, zipper tapes 22 and 22' can be introduced between the already folded film with flanges 28, 30 and 32,34 being sealed at the same time to the respective film web areas. In such an instance, separating plates may be positioned between mutually opposed flanges to prevent seal-through, as will be described in more detail later with reference to FIG. 21.

The precursor structure shown in FIG. 3 is folded along a central zone 8 to form the triply folded structure depicted in FIG. 4, the folding operation being substantially similar to that previously described in connection with FIG. 2. As seen in FIG. 4, the folded web 2 reverses its direction along the folds 6', 8 and 6 to form a serpentine cross-sectional profile similar to that previously described with reference to FIG. 2, with first and second walls 10 and 12 on one side of central fold 8, and third and fourth walls 14 and 16 on the other side of the central fold 8. The zipper tapes 22 and 22' with sliders 25 project upward on opposite sides of the central fold 8 of the inverted U-shaped precursor structure.

In the configuration shown in FIG. 4, both sides of the W-shaped structure can be cross-sealed to form individual receptacles. The slider on each zipper segment corresponding to a receptacle to be filled is then mechanically moved from the closed position to the open position, thereby opening the formed receptacle for filling. The interior volumes of the receptacles are filled through the open zippers. The sliders are then used to close the zipper. Alternatively, the slider is kept stationary and the zipper is moved through the slider to open it before filling and is then mechanically closed after filling. Then the zippers are closed. Following the filling operation, the two chains of filled receptacles are advanced one package increment. During this advance, a cut 56 is made in fold 8 to sever the pair of filled packages at the termini of the chains from each other. The respective filled packages of this terminal pair are then severed from the respective chains to form a pair of severed completed packages.

Any of the packages disclosed herein can be provided with tamper-evident features, such as a peel seal inside the interior of the package. For the purpose of illustration, alternative tamper-evident features are shown in FIG. 4. In accordance with a first alternative, opposing zipper flanges of each zipper tape may be sealed together by a respective peel seal 90, indicated by small dashed rectangles in FIG. 4. The peel seal material can be applied on one of the zipper flanges before the zipper tapes are joined to the bag making film. The peel seal can be formed by pressing the zipper flanges together while applying sufficient heat to activate the peel seal material. Such a peel seal must be broken or ruptured in order to gain access to the interior volume of the package, thereby leaving evidence that warns a consumer that the package has been tampered with. In accordance with a second alternative, the zipper flanges of each zipper tape may be connected by an integrally formed web or membrane 52, which is indicated by dotted curved lines in FIG. 4. In this case, each web 52 has a line of weakness (not shown) to facilitate tearing or rupture of the web in a preferred direction generally parallel to the zipper.

In accordance with further alternatives, the final packages can be provided with headers that form enclosed volumes above the zippers to prevent tampering with the contents of the package. In the case of the embodiment depicted in FIG. 4, respective header webs can be folded over and attached to the tops of the respective chains of receptacles after cutting along line 56. Alternatively, the web of bag making film is wide enough and the zipper tapes are positioned such that after cutting along line 56, the edges of the web of bag making film can be sealed together to form respective headers over the zippers. Instead of the bag making film being sealed to itself at the apex of the header, a strip of peel seal material could be placed between the opposing edges of the web to join them together, as will be described in more detail later with reference to FIG. 20. The foregoing header configurations have equal application in the context of the other embodiments described below in which the zippers are installed at the tops of the folded web and not in the folded bottoms of the web of bag making film.

Figure 5:
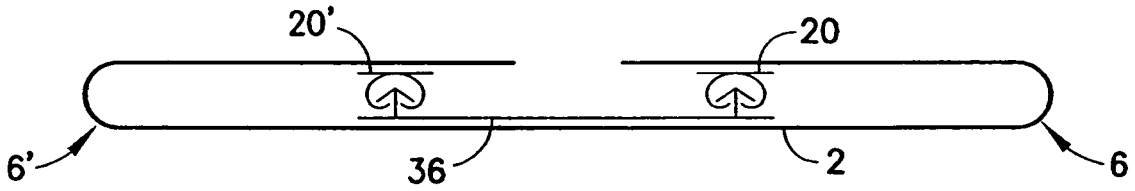
FIG. 5 is a drawing showing a sectional view of a precursor article in accordance with a further embodiment of the invention.
Figure 6:
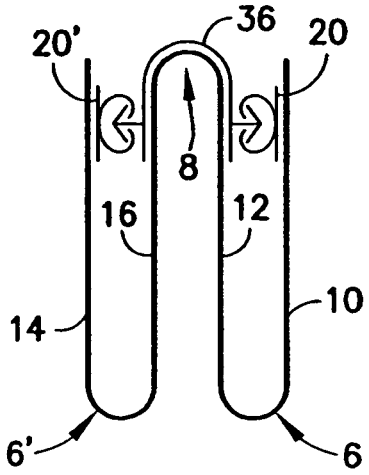
FIG. 6 is a drawing showing a sectional view of the precursor article of FIG. 5 after a further folding step.

In connection with the embodiment of FIGS. 1 and 2, a variation was described in which the zipper tapes would be placed on the web of bag making film along mutually parallel zones located proximal to and on opposite sides of the central folding zone. FIG. 5 shows a further variant wherein two of the four zipper strips are connected to form a zipper strip 36 having two mutually parallel profiled closure members projecting from the same side of an extended base. Each closure member on strip 36 is interlocked with a respective complementary closure member of a respective zipper strip 20 or 20'. The strip 36 (carrying interlocked strips 20 and 20') is sealed or otherwise joined to a central zone of the web 2 of bag making film and then the outer sections of the web are folded over the zipper strips 20 and 20' and sealed thereto. [Alternatively, the zipper strips 20 and 20' could be joined to the web 2 near the edges of the latter and then interlocked with the closure members of strip 36 when the outer sections of the web are folded over.] The result of these method steps is depicted in FIG. 5. Then the web 2 and strip 36 are folded in the middle to form fold 8, as seen in FIG. 6, the folding action being in a direction opposite to that of folds 6 and 6'. While in the upright position shown in FIG. 6, both U-shaped halves of the folded web of bag making film are cross sealed to form respective chains or series of receptacles. The zippers of each successive pair of side-by-side receptacles can be opened to enable the receptacles to be filled. Again, this can be accomplished by separating the zipper strips 20 and 20' and adjoining strip 36 e.g., by means of a separating finger positioned between the strips, as will be described in more detail later with reference to FIGS. 22 and 23. Then the respective zippers on the most recently filled pair of receptacles are closed and the projecting top edges of the bag making film can be sealed together to form headers over the zippers in conventional manner. Then the completed packages can be severed from the respective chains of receptacles by transverse cutting, as previously described.

In accordance with an alternative method of manufacture, the edges or adjacent area of the folded-over portions of the web are not sealed to the zipper strips 20 and 20' until after filling, in which case the receptacle formed later by cross sealing can be filled by pulling the opposing edges of the folded-over web portions away from the adjoining zipper strips and filling the receptacle through the gaps between the web portions and the zipper strips. Thereafter the adjacent portions of the bag making film are sealed or otherwise joined to the zipper strips 20 and 20'.

Figure 7:
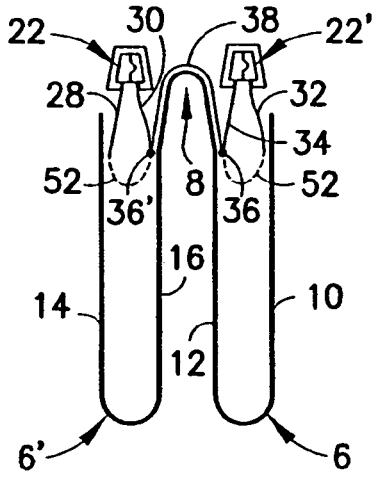
FIG. 7 is a drawing showing a sectional view of a precursor article having a hinged zipper in accordance with a further embodiment of the invention.
Figure 8:
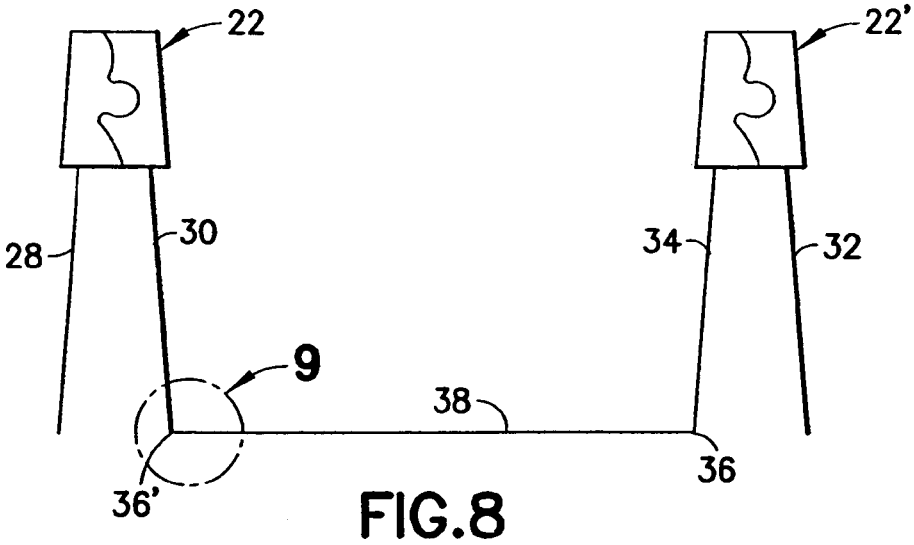
FIG. 8 is a drawing showing a hinged zipper construction in accordance with the embodiment shown in FIG. 7.
Figure 9:
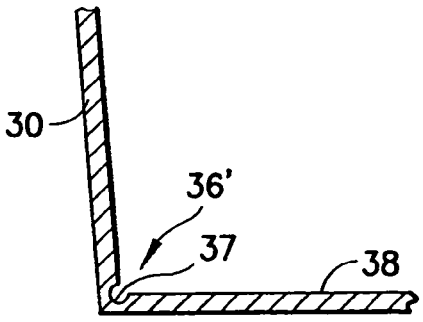
FIG. 9 is a drawing showing the hinge of the hinged zipper of FIG. 8 in detail.

FIG. 7 depicts another embodiment of a precursor structure in which respective parts of two zipper tapes (with sliders 25 inserted thereon) are connected by an integrally formed web or membrane 38, forming a hinged zipper assembly. As best seen in FIG. 8, one end of the web 38 and one end of a zipper flange 34 are connected at a first hinge line 36', while the other end of the zipper flange 34 is connected to a profiled closure member of one slider-operated zipper 22'. The other end of the web 38 and one end of a zipper flange 30 are connected at a second hinge line 36', while the other end of the zipper flange 30 is connected to a profiled closure member of the other slider-operated zipper 22. This zipper structure is integrally formed. Each hinge line may comprise a corner section having necked or narrowed segments that meet at a vertex 37 (see FIG. 9) to form a profile that flexes from a relatively open configuration to a relatively closed configuration as the hinged zippered structure is bent and folded into the generally W-shaped configuration seen in FIG. 7.

The central web 38 is sealed or otherwise joined to a central zone of the web of bag making film and then folded as shown to form the central inverted fold 8. In addition, a pair of zipper strips, each comprising a profiled closure member and a zipper flange having one end connected to the profiled closure member, is attached to parallel outer portions of the web of bag making film. The zipper strips are located and oriented so that when the outer section of the web are folded over, the closure members of the zipper strips can be interlocked with the closure members of the central zippered structure, as seen in FIG. 8. The zipper flange 28 of one zipper strip is sealed to a portion of the web that becomes part of wall 14, while the zipper flange 32 of the other zipper strip is sealed to a portion of the web that becomes part of wall 10. In this embodiment, the receptacles formed by cross sealing can be opened by mechanically moving the sliders relative to the zippers and then the open receptacles are filled. Then the zippers of the filled receptacles can be closed, again by mechanically moving the slider, and separate filled packages can be severed from the respective chains by cutting. Alternatively, as indicated previously, the slider can be stationary while the zipper is moved through the slider to open the receptacle.

In accordance with a variation of the embodiment shown in FIG. 7, the opposing zipper flanges of each zipper can be connected by an integrally formed web or membrane 52, indicated by dashed curved lines in FIG. 7. These webs or membranes provide a tamper-evident feature.

Figure 10:
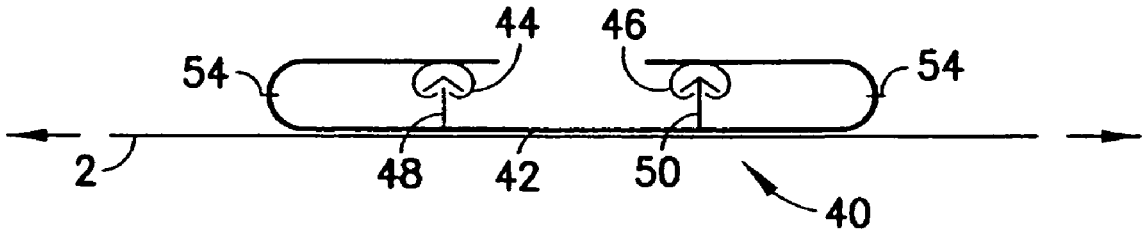
FIG. 10 is a drawing showing a sectional view of a precursor article in accordance with another embodiment of the invention, the view being taken before the web of bag making film is folded.
Figure 11:
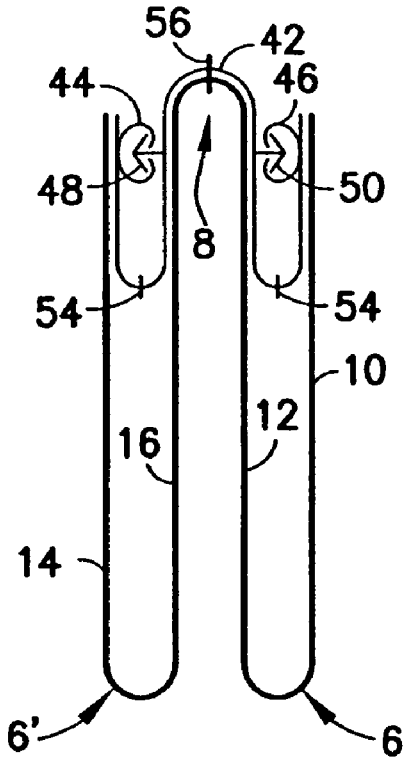
FIG. 11 is a drawing showing a sectional view of the precursor article of FIG. 8 after the web of bag making film has been folded.

FIGS. 10 and 11 depict an embodiment of the invention wherein the entire double-zippered structure 40 is integrally formed. The integrally formed zippered structure 40 comprises a web 42 and first through fourth profiled closure members connected to the web 42. The closure members are disposed generally in parallel with each other, the first closure member 48 being interlocked with the second closure member 44, and the third closure member 50 being interlocked with the fourth closure member 46. The web 42 comprises first and second web portions connected by a third web portion. In the particular example depicted in FIG. 10, the third web portion extends from the base of the male closure member 48 to the base of the male closure member 50. The first web portion extends from one zone connected to closure member 44 to another zone connected to the closure member 48 (and to the third web portion), while the second web portion extends from one zone connected to closure member 46 to another zone connected to closure member 50 (and to the third web portion). The double-zippered structure 40 can be made by extruding a planar web with the four profiled closure members running in parallel at spaced intervals along the length of the web. Then the outer sections of the web are folded over and the opposing closure members are interlocked as seen in FIG. 10. Before folding, two lines of weakness 54 can be formed in the web, the lines of weakness being placed on the web such that they lie at the cusp of the folds when the web 42 is folded. Each line of weakness may comprise a line of perforations covered by a thin sealing strip or a score line formed by a laser beam.

As seen in FIG. 10, the spine of the zippered structure 42 is sealed or otherwise joined to a flat web 2 of tensioned bag making film. The zippered structure 42 can be joined along one or more zones of joinder. Multiple zones of joinder are mutually parallel. The resulting structure is then folded three times along mutually parallel zones of folding 6, 6' and 8, to arrive at the configuration shown in FIG. 11. After the outer sections of web 2 are folded over to form folds 6 and 6', the folded-over web portions overlapping zipper closure members 44 and 46 are not yet joined to the respective adjacent portions of zipper web 42. Before or after the aforementioned folding steps, the central portions of the web 2 of bag making film and the zipper web 42 are folded in the opposite direction to form an inverted (i.e., upside down) U shape that connects the U shapes formed by folds 6 and 6'. While in the upright position shown in FIG. 11, both U-shaped halves of the folded web of bag making film 2 first have their outer sections sealed to the adjacent portions of zipper web 42 and then are cross sealed to form respective chains or series of receptacles. The zippers of each successive pair of side-by-side receptacles can be opened to enable the receptacles to be filled. Again, this can be accomplished by separating closure member 44 from 48 and closure member 46 from 50 by means of a separating finger. In accordance with another method of manufacture, the folded-over portions 6 and 6' of the web are not sealed to the adjoining zipper strips 20 and 20' until after filling, in which case the receptacles subsequently formed by cross sealing can be filled by pulling the opposing edges of the folded-over web portions away from the adjoining zipper strips and filling the receptacle through the gaps between the web portions and the zipper strips. In either case, after the filling operation, the respective chains of receptacles are severed from each other and then respective completed packages are severed from the respective chains of receptacles. Optionally, tamper-evident headers can be made (in any one of the ways previously described) before the cutting operations.

In accordance with an alternative embodiment, the webless zippers of the embodiment shown in FIG. 2 can be replaced by flanged zippers operated by sliders, the latter being placed upside down proximal to the bottom folds in the generally W-shaped folded web of bag making film. The zipper tapes with sliders can be joined to the web of bag making film either before or after folding of the bag making film. To illustrate one embodiment of a dual-capacity HFVF machine, the embodiment wherein the zipper tapes are joined to the web of bag making film before folding will now be described with reference to FIGS. 12–18.

Figure 12:
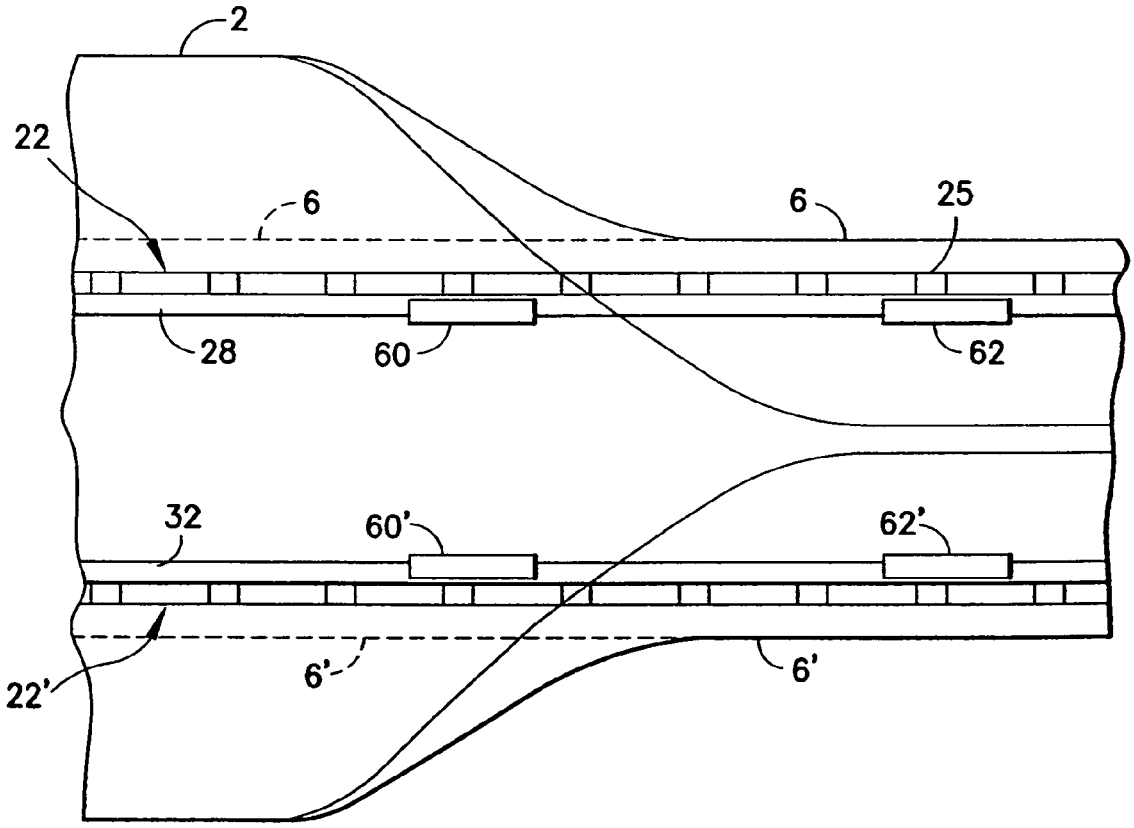
FIG. 12 is a drawing showing a top plan view of a stage in a method of manufacturing yet another embodiment of the invention. For the sake of illustration, it has been assumed that the bag making film is optically transparent, so that structural features disposed under the folded film are visible. The manufacturing stage depicted in FIG. 12 precedes the step wherein the web of bag making film is folded along a central zone.

FIG. 12 depicts a flat horizontal web 2 of bag making film being folded along a pair of parallel fold lines 6 and 6' as it advances in a machine direction. This can be accomplished using a folding board (not shown). The web 2 entering this folding station carries two zipper tapes 22 and 22', each zipper tape having a multiplicity of sliders 25 inserted thereon. The sliders 25 are spaced at equal intervals, one slider for each length of bag making film equal to the width of the final package. In this example, each zipper strip of the respective zipper tapes comprises a respective profiled closure member and a respective zipper flange having one end connected to the respective closure member. The closure members of each zipper tape have complementary mating profiles. In the top view of FIG. 12, only zipper flanges 28 and 32 of zipper tapes 22 and 22' are visible, although it should be understood the a respective lower zipper flange lies directly below the zipper flanges 28 and 32. At a first sealing station, a lower sealing bar (not visible in FIG. 12) and an upper pressure plate 60 located directly above the lower sealing bar and between the zipper flanges apply pressure and conductive heat to seal the lower zipper flange (not visible) of zipper tape 22 to the web 2, while another upper pressure plate 60' and another lower sealing bar (not visible in FIG. 12) located directly below upper pressure plate 60' apply pressure and conductive heat to seal the lower zipper flange (not visible) of zipper tape 22' to the web 2. In this example, the zipper tapes are aligned with the machine direction and disposed between the fold lines 6 and 6' with zipper flanges pointing toward the center of the web 2. Ultimately, the fold lines 6 and 6' will form the apices of headers on the tops of the final packages. Immediately after the first sealing station, the outer sections of the web 2 of bag making film are folded over the zipper tape, as seen in FIG.

12. For the purpose of this example, it is assumed that the bag making film is optically transparent, so that the portions of the zipper tape lying underneath the folded-over portions of the web 2 are visible in FIG. 12. At a second sealing station, an upper sealing bar 62 and a lower pressure plate (not visible in FIG. 12) located directly below sealing bar 62 and between the zipper flanges apply pressure and conductive heat to seal zipper flange 28 of zipper tape 22 to the opposing folded-over portion of web 2, while another upper sealing bar 62' and a lower sealing bar (not visible in FIG. 12) located directly below sealing bar 62' apply pressure and conductive heat to seal zipper flange 32 of zipper tape 22' to the opposing folded-over portion of web 2. The web of bag making film then advances to the next station.

At the next station, the web 2 of bag making film is converted from a horizontal position to a vertical position. In the process, the web 2 is folded along a centerline to form the generally W-shaped profile shown in FIG. 15. More specifically, the web 2 is folded against and wrapped around an upright support plate 82, which preferably has a profile comprising substantially mutually parallel planar side walls, the surfaces of which are connected by a circular semi-cylindrical surface at the upper end of the support plate. The axis of the semi cylindrical surface of support plate 82 is aligned in the machine direction, i.e., the direction in which the web of bag making film advances during this stage of manufacture.

Figure 13:
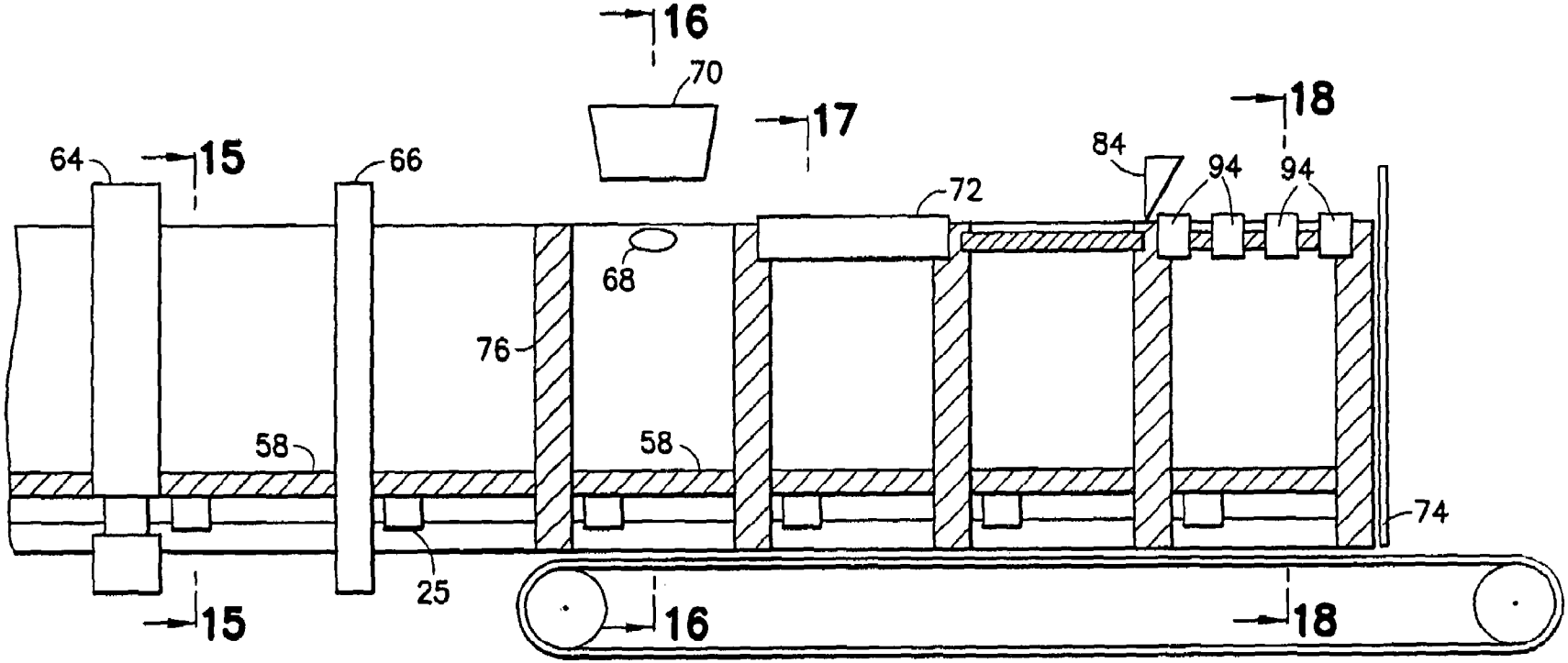
FIGS. 13 and 14 are drawings respectively showing side elevational and top plan views of a later stage in the method of manufacture partially depicted in FIG. 12. The manufacturing stage depicted in FIGS. 13 and 14 is subsequent in time to the step wherein the web of bag making film is folded along a central zone.
Figure 14:
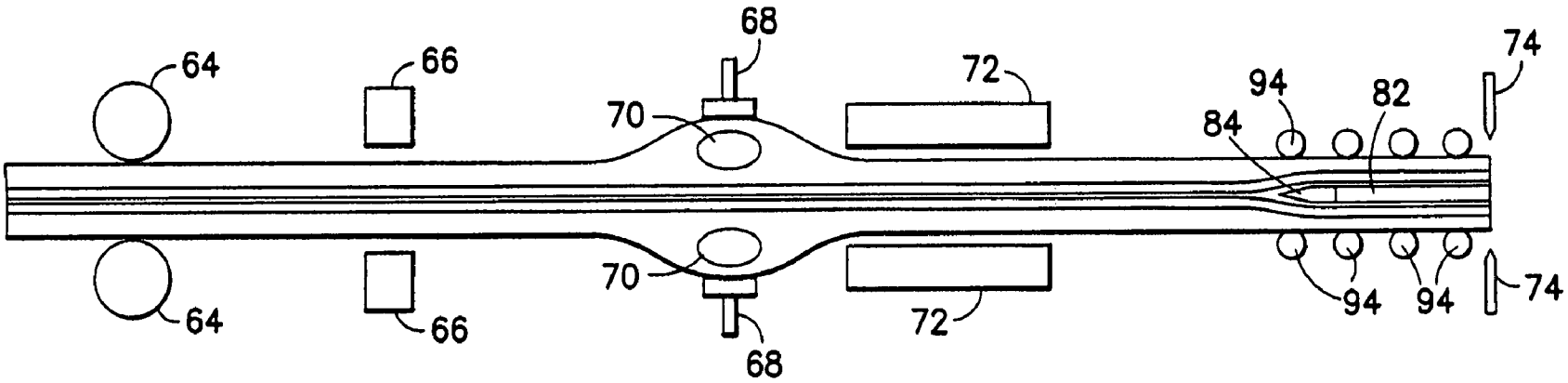
Figure 15:
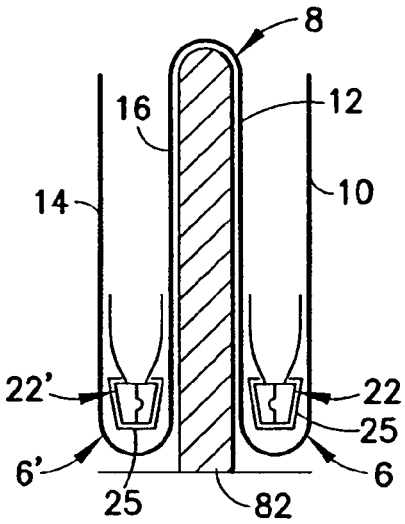
FIGS. 15–18 are drawings showing respective sectional views of the machine depicted in FIG. 13, the sections being taken along the lines designated 15—15, 16—16, 17—17, and 18—18 respectively in FIG. 13.

Referring to FIGS. 13 and 14, the folded web 2 with zipper tapes attached and with sliders 25 inserted at spaced intervals along the zipper tapes is pulled forward by a pair of upright grooved drive rolls 64 arranged in opposition to opposing side walls of the support plate 82. Respective portions of the generally W-shaped web pass between respective nips formed between the drive rolls 64 and the support plate 82 disposed therebetween. The annular grooves in the drive rolls 64 have a width greater than the height of the sliders 25 and are vertically positioned to allow the sliders to pass through the grooves when the web of bag making film with attached zipper tape is advanced. The hatched band-shaped area designated 58 indicates the zipper flange-to-film permanent seals formed at the first and second sealing stations, previously described.

Figure 16:
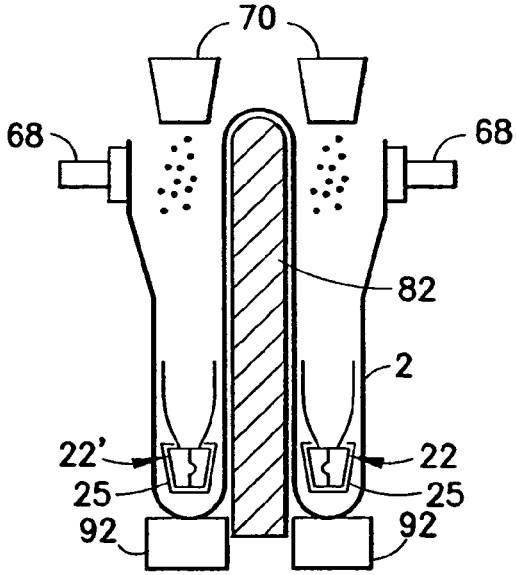
Figure 17:
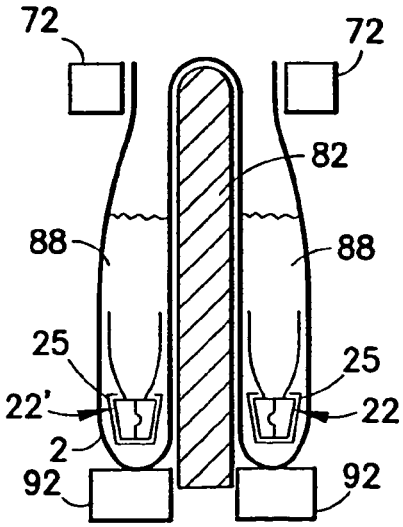
Figure 18:
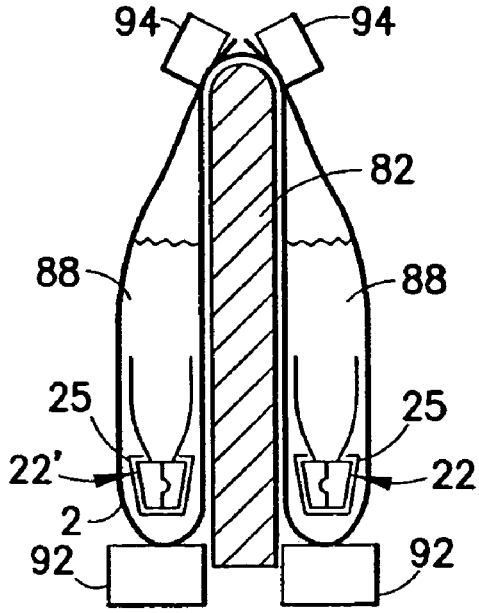

At a third sealing station, a vertical sealing bar 66 and a vertical sealing bar (not visible in FIG. 10) located directly behind sealing bar 66 apply sufficient pressure and conductive heat to form transverse or cross seals 76 at spaced intervals along the length of the web. Each cross seal 76 is a band-shaped zone, which is subsequently bisected when the completed package is severed from the chain, thereby forming side seals on two packages. The cross seals in combination with the bottom folds form respective receptacles that are filled at a filling station having a pair of fill tubes or spouts 70. The unsealed ends of the respective receptacles at the filling station are opened wider by means of a pair of retractable suction or vacuum-activated cups 68. The cups 68 are advanced into position in abutment with the outer walls of the W-shaped web of bag making film, the suction or vacuum is applied, and then the cups 68 are retracted while holding the web walls, causing the outer walls to spread outward, as seen in FIG. 14. The product is then poured through the fill tubes 70 and into the respective receptacles, as depicted in FIG. 16. When the receptacle is filled with product, the vacuum cups are returned to their original positions and the vacuum is released. Then the filled receptacle is advanced to another sealing station where the open top of the receptacle (which will be the bottom of the completed package) is sealed. At the fourth sealing station, a pair of horizontal sealing bars 72 apply sufficient pressure and conductive heat to form a horizontal seal across the top of the web, thereby closing the respective receptacles. FIG. 17 shows the seal bars 72 in their retracted positions. When they are extended, the top edges of the two separated receptacles are sealed. It should be noted that the sealing bars at the third and fourth stations press the web of bag making film against the sides of the support plate 82. After the top sealing operation, the web is advanced. During this advance, the top sealed filled receptacle is cut along the central fold 8 by a knife 84. To advance the receptacles now separated by knife 84, rollers 94 on either side of the support plate 82, positioned at a slant if so required (see FIG. 18), in conjunction with belts 92 under the filled receptacles, move the receptacles through the fourth sealing station. Additional rollers can be located at different positions in the HFVF machine either on the sides of the web or above, as indicated previously, to move the web through the other positions. Finally, the completed packages are severed from the respective chains of receptacles by a pair of knives 74 that cut through the center of seal 76 (see FIGS. 13 and 14).

Figure 19:
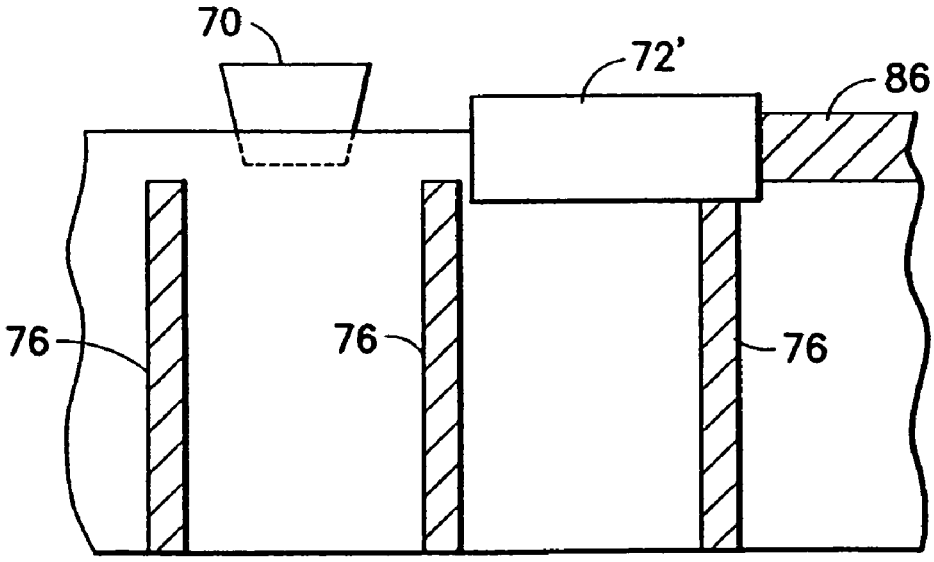
FIG. 19 is a drawing showing a side elevational view of a variation of the method of manufacture depicted in FIG. 13.

In accordance with an alternative embodiment shown in FIG. 19, the cross seal bars do not reach the top edges of the folded web of film and the film passes on both sides of each fill spot 70. In this case, the seal bars 72' are wider. The resulting bottom seal is indicated by the hatched region designated by the numeral 86.

Figure 20:
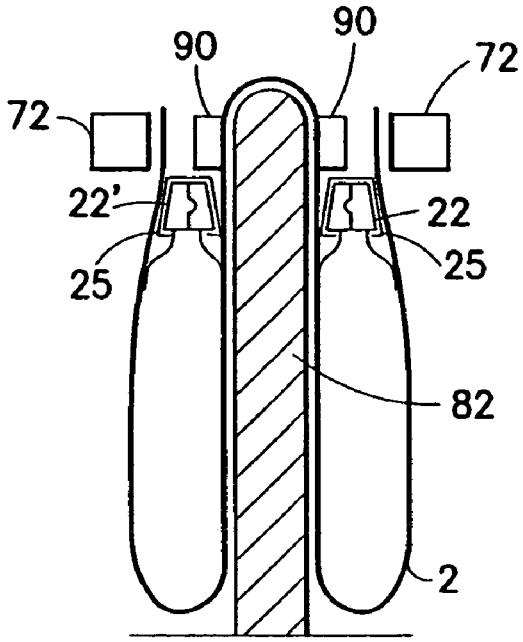
FIG. 20 is a drawing showing a sectional view of a precursor article provided with peel seals in accordance with yet another embodiment of the invention.

In accordance with a further embodiment of the invention, slider-operated zippers can be installed on either side of the central fold instead of proximal to the outer folds of the generally W-shaped web 2 of bag making film. This situation is depicted in FIG. 20, wherein numerals 22 and 22' designate the respective zipper tapes installed between the walls of the folded web. Strips 90 of peel seal material are joined to one wall of each side of the W-shaped web 2. Before the knife 84 severs the two sides of the folded web from each other, the horizontal seal bars 72 activate the peel seal. FIG. 20 shows the seal bars 72 in the retracted position and the peel seal material 90 not yet activated.

Figure 21:
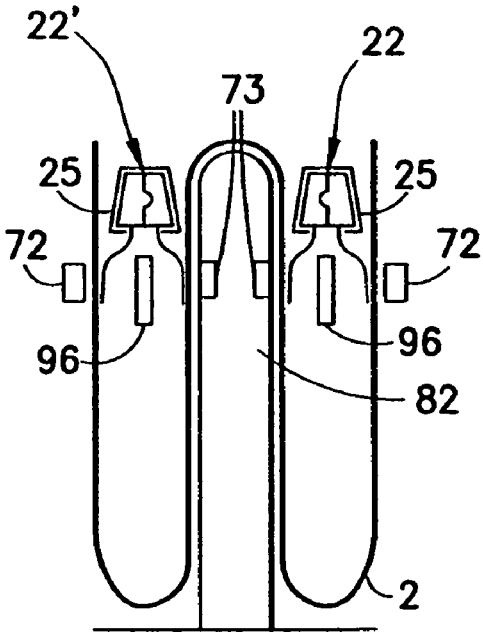
FIG. 21 is a drawing showing a method for attaching flanged zipper assemblies inside the folds of a doubly folded web of bag making film.
Figure 22:
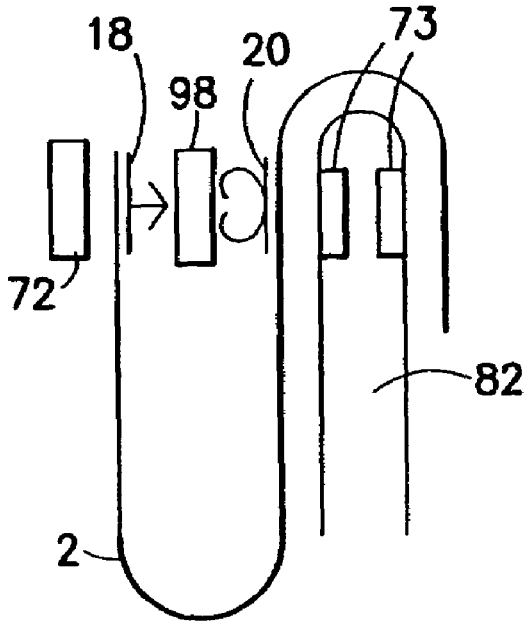
FIG. 22 is a drawing showing a method for attaching string zipper assemblies inside the folds of a doubly folded web of bag making film.
Figure 23:
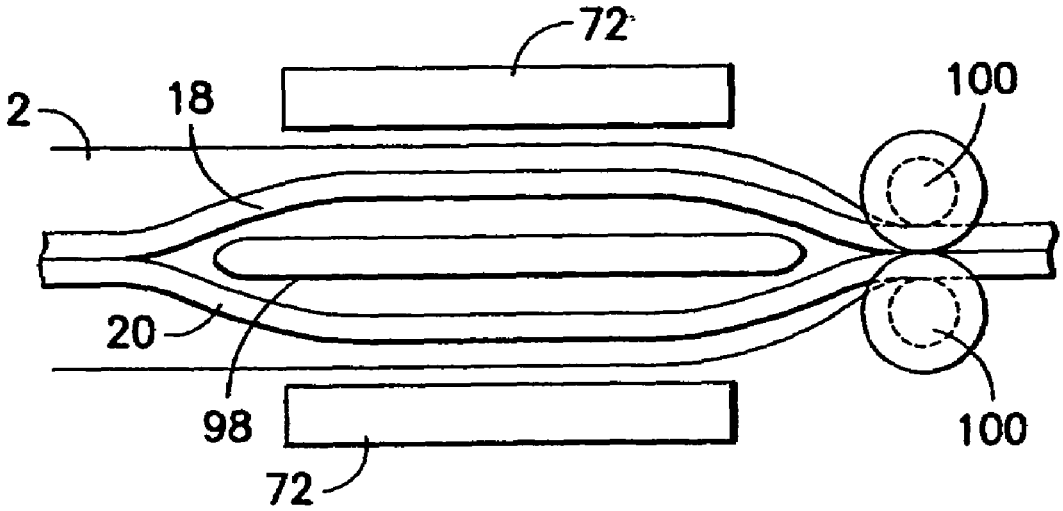
FIG. 23 is a drawing showing a top view of the zipper sealing arrangement being used in FIG. 22.

In many of the methods of manufacture disclosed hereinabove, zipper strips are attached to the web of bag making film before the web is folded. Alternatively, the web of bag making film can be folded to have the above-described generally W-shaped serpentine profile and then the zipper strips are inserted in between the folded portions and sealed to the web, as shown in FIG. 21, by outside seal bars 72 and opposing seal bars 73 contained within the support plate 82. This is followed by cross sealing, filling and cutting as previously described. In such an instance, separating plates 96 can be introduced between the zipper flanges to prevent seal through when sealing the flanges to film web 2. If the zippers do not have flanges, being sealed to the film by their base, their interlocking elements can be separated by a separating plate 98 introduced between the interlocking elements in the sealing area and then being rejoined by a pair of rollers 100, as shown in FIGS. 22 and 23.

While the invention has been described with reference to preferred embodiments, it will be understood by those skilled in the art that various changes may be made and equivalents may be substituted for members thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

As used in the claims, the verb "joined" means fused, bonded, sealed, adhered, etc., whether by application of heat and/or pressure, application of ultrasonic energy, application of a layer of adhesive material or bonding agent, interposition of an adhesive or bonding strip, etc. As used in the claims, the term "zipper tape" comprises either a pair of zipper strips comprising respective interlocked profiled closure members or a monolithic structure comprising a pair of interlocked profiled closure members connected by a folded web or membrane.

The invention claimed is:

1. A method of manufacturing an article, comprising the following steps:

extending a web of bag making film under tension in a machine direction;

joining a first zipper tape to said web along a first zone of joinder generally aligned with said machine direction;

joining a second zipper tape to said web along a second zone of joinder generally parallel to said first zone of joinder of said first zipper tape and spaced apart therefrom; and folding said web in first, second and third mutually parallel zones extending in said machine direction, said first zone of folding being disposed between a first edge of said web and said first zipper tape, said second zone of folding being disposed between said first and second zipper tapes, and said third zone of folding being disposed between said second zipper tape and a second edge of said web, joining said first zipper tape to said web along a third zone of joinder generally parallel to said first zone of joinder; and joining said second zipper tape to said web along a fourth zone of joinder generally parallel to said second zone of joinder;

wherein said first and third zones of folding are folded before said second zone of folding is folded.

2. The method as recited in claim 1, wherein said first and third zones of folding are folded in a first direction and said second zone of folding is folded in a second direction opposite to said first direction.

3. The method as recited in claim 1, wherein said folded web reverses its direction along said folds to form a serpentine cross-sectional profile with first through fourth walls, said second wall being disposed between said first and third walls, said third wall being disposed between said second and fourth walls, a bottom of said first wall being connected to a bottom of said second wall along said first fold, a top of said second wall being connected to a top of said third wall along said second fold, and a bottom of said third wall being connected to a bottom of said fourth wall along said third fold.

4. The method as recited in claim 3, further comprising the steps of cross sealing said first and second walls at regular spaced intervals to separate the space between said first and second walls into a first series of receptacles, and cross sealing said third and fourth, walls at said regular spaced intervals to separate the space between said third and fourth walls into a second series of receptacles.

5. The method as recited in claim 1, further comprising the steps of inserting a first multiplicity of sliders on said first zipper tape and inserting a second multiplicity of sliders on said second zipper tape.

6. A method of manufacturing an article, comprising the following steps:

extending a web of bag making film under tension in a machine, direction;

joining a first zipper tape to said web along a first zone of joinder generally aligned with said machine direction;

joining a second zipper tape to said web along a second zone of joinder generally parallel to said first zone of joinder of said first zipper tape and spaced apart therefrom;

folding said web in first, second and third mutually parallel zones extending in said machine direction, said first zone of folding being disposed between a first edge of said web and said first zipper tape, said second zone of folding being disposed between said first and second zipper tapes, and said third zone of folding being disposed between said second zipper tape and a second edge of said web;

joining said first zipper tape to said web along a third zone of joinder generally parallel to said first zone of joinder;

joining said second zipper tape to said web along a fourth zone of joinder generally parallel to said second zone of joinder;

intermittently advancing said web in said machine direction; and cutting a leading portion of said second zone of folding during said advancing step.

7. A method of manufacturing an article, comprising the following steps:

extending a web of bag making film under tension in a machine direction;

joining a first zipper tape to said web along a first zone of joinder generally aligned with said machine direction;

joining a second zipper tape to said web along a second zone of joinder generally parallel to said first zone of joinder of said first zipper tape and spaced apart therefrom;

folding said web in first, second and third mutually parallel zones extending in said machine direction, said first zone of folding being disposed between a first edge of said web and said first zipper tape, said second zone of folding being disposed between said first and second zipper tapes, and said third zone of folding being disposed between said second zipper tape and a second edge of said web, wherein said folded web reverses its direction along said folds to form a serpentine cross-sectional profile with first through fourth walls, said second wall being disposed between said first and third walls, said third wall being disposed between said second and fourth walls, a bottom of said first wall being connected to a bottom of said second wall along said first fold, a top of said second wall being connected to a top of said third wall along said second fold, and a bottom of said third wall being connected to a bottom of said fourth wall along said third fold;

joining said first zipper tape to said first wall along a third zone of joinder generally parallel to said first zone of joinder;

joining said second zipper tape to said fourth wall along a fourth zone of joinder generally parallel to said second zone of joinder;

cross sealing said first and second walls at regular spaced intervals to separate the space between said first and second walls into a first series of receptacles;

cross sealing said third and fourth walls at said regular spaced intervals to separate the space between said third and fourth walls into a second series of receptacles;

filling respective receptacles of said first and second series with product; and sealing and severing said filled receptacles.

8. The method as recited in claim 7, wherein said filling step comprises filling product through open sections of said first and second zipper tapes.

* * * * *